US005236312A

United States Patent [19]

Finn et al.

[11] Patent Number: 5,236,312

[45] Date of Patent: Aug. 17, 1993

[54] SWASH-PLATE-TYPE AIR CONDITIONING PUMP

[75] Inventors: Thomas E. Finn; Scott H. Wenzel, both of Canton; Craig A. Mikolajczyk, Garden City; Patrick J. Mockeridge, Redford, all of Mich.

[73] Assignee: Ford Motor Company, Dearborn, Mich.

[21] Appl. No.: 811,664

[22] Filed: Dec. 23, 1991

[51] Int. Cl.[5] ..... F04B 1/12; F04B 21/00

[52] U.S. Cl. ..... 417/269; 417/312

[58] Field of Search ..... 417/269, 312

[56] References Cited

U.S. PATENT DOCUMENTS

| | | | |
|---|---|---|---|
| 3,380,651 | 4/1968 | Akiraniki et al. | 417/269 |
| 3,577,891 | 5/1971 | Nemoto et al. . | |
| 3,820,921 | 6/1974 | Thayer . | |
| 4,101,250 | 7/1978 | Nakayama et al. . | |
| 4,407,638 | 10/1983 | Sasaya et al. | 417/312 |
| 4,432,702 | 2/1984 | Honzawa et al. . | |
| 4,534,710 | 8/1985 | Higuchi et al. . | |
| 4,610,604 | 9/1986 | Iwamori | 417/269 |
| 4,767,283 | 8/1988 | Ikeda et al. | 417/269 |
| 4,934,482 | 6/1990 | Herron et al. | 181/224 |
| 4,950,132 | 8/1990 | Brian, Jr. et al. | 417/269 |
| 5,051,069 | 9/1991 | Ikeda et al. | 417/269 |

FOREIGN PATENT DOCUMENTS 2165477 8/1973 France .

*Primary Examiner*—Richard A. Bertsch
*Assistant Examiner*—Alfred Basichas
*Attorney, Agent, or Firm*—Roger L. May; Raymond L. Coppiellie

[57] ABSTRACT

A double-acting, multi-cylinder, swash-plate-type air conditioning pump (10) for propelling refrigerant gas through a cooling circuit. The pump (10) comprises a cylinder block assembly (16) which is provided with a plurality of reciprocating pistons (18). Each piston (18) is in communication with a swash-plate (20) which is fixedly mounted on an axially extending, rotatable shaft (22). The pistons (18) are adapted for syphoning, compressing, and discharging the refrigerant gas. A refrigerant gas flow path (24) is defined within and in communication with the plurality of reciprocating pistons (18) so as to minimize peak-to-peak pressure pulsation and consequent noise and vibration. The gas flow path (24) has a discharge cavity port (28), and a discharge port (32). Linking them is an arcuately extending discharge transfer cavity (30) for delivering the refrigerant gas (12) after compression. The discharge cavity port (28) is arcuately spaced apart from the pump discharge port (32).

8 Claims, 2 Drawing Sheets

SWASH-PLATE-TYPE AIR CONDITIONING PUMP

TECHNICAL FIELD

This invention relates to a swash-plate-type air conditioning pump which is preferably adapted for use in an automobile. More specifically, the invention relates to a swash-plate-type air conditioning pump with double-acting pistons. The invention discloses an internal discharge cavity modification for such pumps, which suppresses pulsation during the discharge of refrigerant gas after compression.

BACKGROUND ART

Most swash-plate-type refrigerant gas compressors used in today's automobile air conditioning systems syphon refrigerant gas returning from the air conditioning system in a multi-cylinder pump. There, the returning gas is compressed by pistons which are operated by a single rotary swash-plate. After compression, the refrigerant gas is discharged from cylinder bores into discharge chambers and is distributed via a discharge cavity through passageways toward a cooling circuit of the air conditioning system.

During compression and discharge of the refrigerant gas, there is a pulsation in the discharge pressure of the gas imposed by reciprocating motion of the pistons. Among other factors, the frequency of pulsation per pump cycle is a function of the number of cylinder bores. Such pulsation requires suppression if noise and vibration problems are to be abated.

Conventional approaches to such problems have provided a chamber with a substantial volume which acts as a muffling chamber. Such approaches are exemplified in U.S. Pat. No. 4,610,604 which issued on Sept. 9, 1986. The disclosure of that patent is hereby incorporated by reference.

As disclosed therein, after compression, refrigerant gas is choked by restraining orifices before entering a muffling chamber and undergoing rapid expansion. Following such teachings, sudden expansion and subsequent choking of refrigerant gas tends to suppress the pulsation caused by reciprocating motion of the pump's pistons. In such approaches, a relatively large volume of muffling chambers is needed to obtain the desired efficiency and frequency of suppression.

Pulsation phenomena in air conditioning pumps can be thought of as a repetitive rise and fall in localized gas pressure. Individual pulses are generated by the member pistons associated with the air conditioning pump. Such pulsation phenomena can be expressed in wave form which graphically symbolizes the relationship of pressure and time at a given sensing location. An increase in the amplitude of pulsation occurs where individual pressure waves become superimposed and augment each other. To achieve a low level of discharge pulsation, the shape of the resultant discharge wave requires accurate, consistent pulse separation. In prior approaches, small phase shifts in the resultant wave form due to the differing effective travel distances from the cylinder port to the pump discharge port may create superposition of individual waves and substantial increases in pulsation levels.

As noted earlier, existing discharge cavity designs may utilize relatively voluminous muffler cavities near the center of the pump to mix the waveforms from the front and rear cylinder heads in order to offset disadvantages which are inherent in the firing sequence of conventional swash-plate designs. While such muffler cavity designs may tend to reduce the overall pulsation level, they generally fail to compensate for variable phase shift caused by the activation sequence of pistons being displaced by the swash-plate. Additionally, such designs also tend to be more complex and costly than may be necessary in light of the present invention.

SUMMARY OF THE INVENTION

An object of the present invention is to reduce peak-to-peak pressure fluctuation of discharge refrigerant gas in double-acting piston pumps wherein the refrigerant gas is compressed by a swash-plate-type compressor.

Another object of the present invention is to provide a multi-cylinder, double-acting piston pump compressor design which has a modified internal discharge cavity which effectively suppresses discharge pressure pulsation.

A further object of the present invention is to provide a multi-cylinder swash-plate-type compressor which operates quietly and without the need to provide muffling chambers of relatively high volume.

In accordance with the present invention, there is provided an internal discharge cavity modification in a swash-plate-type air conditioning pump which has double-acting pistons. The modified discharge cavity reduces peak-to-peak pressure fluctuation of compressed refrigerant gas, thereby reducing noise and vibration levels.

The discharge cavity modification relocates a discharge cavity port and concomitantly the travel distance of discharge gas in a discharge transfer cavity. As a result, no internal or external muffler cavities are required to achieve similar reductions in noise and vibration levels.

As used herein, the term "discharge cavity" is defined as that space which is enclosed by cylinder heads and cylinder blocks. In a multi-cylinder air conditioning pump, refrigerant gas which is discharged from individual cylinder ports associated with each cylinder chamber travels into the discharge cavity, through the discharge cavity port, and into the discharge transfer cavity. Mixing of the discharge gas from cylinders associated with front and rear halves of the pump occurs in a mixing chamber at the distal end of the rear discharge transfer cavity before it exits the pump through a pump discharge port.

In the air conditioning pump design disclosed, the swash-plate is located between a rear and a front cylinder block. Within each block, there preferably are five pistons. In a manner to be described in further detail later in the specification, two conditions must be met in order to reduce peak-to-peak discharge pressure pulsation. First, for a given volume and cross-section of discharge cavity, the travel distance of refrigerant gas from a given cylinder port to the discharge cavity port on one (e.g. the rear) side of the air conditioning compressor pump must equal the corresponding travel distance of refrigerant gas on the opposite (e.g. the front) side of the pump for all cylinders when their activation sequence is considered. Second, for a given volume and cross-section of discharge transfer cavity, the discharge transfer cavity lengths from the front and rear discharge cavities to the mixing chamber must be approximately equivalent.

To satisfy these conditions, the rear discharge cavity port is relocated counterclockwise from the pump discharge port when viewed from the front cylinder block. It has been found that when the pump includes ten pistons, i.e. the five double-acting piston design, an arcuate displacement of about 144 degrees satisfies the offset requirement.

To route refrigerant gas to the mixing chamber of the rear cylinder head, an arcuately extending discharge transfer cavity is used. Its length is equivalent to the axially extending transfer cavity which is used to route the refrigerant gas from the front head discharge cavity into the mixing chamber.

While discharge transfer cavity paths from the rear and front discharge cavities may be disposed arcuately or axially for packaging convenience, their lengths must be equivalent.

In accordance with the present invention, there is provided an air conditioning pump for propelling refrigerant gas through a cooling circuit. The pump comprises a cylinder block assembly which is provided with a plurality of reciprocating pistons, each piston moving within a cylinder chamber and being in communication with a swash-plate that is fixedly mounted on an axially extending, rotatable shaft. Each piston is adapted within its associated chamber for siphoning, compressing, and discharging the refrigerant gas. The refrigerant gas travels along a refrigerant gas flow path defined within the cylinder block and cylinder head assemblies and is in communication with the plurality of reciprocating pistons. Along the refrigerant gas flow path is a discharge cavity with a discharge cavity port leading to a discharge transfer cavity in communication therewith. The discharge transfer cavity ducts to a pump discharge port for delivering the refrigerant gas to a cooling circuit after compression. To suppress peak-to-peak pressure fluctuation and reduce consequent noise and vibration, the discharge cavity port is circumferentially spaced apart from the pump discharge port.

The above objects and other objects, features, and advantages of the present invention are readily apparent from the following detailed description of the best mode for carrying out the invention when taken in connection with the accompanying drawings.

DESCRIPTION OF THE PREFERRED EMBODIMENT

Figure 1:
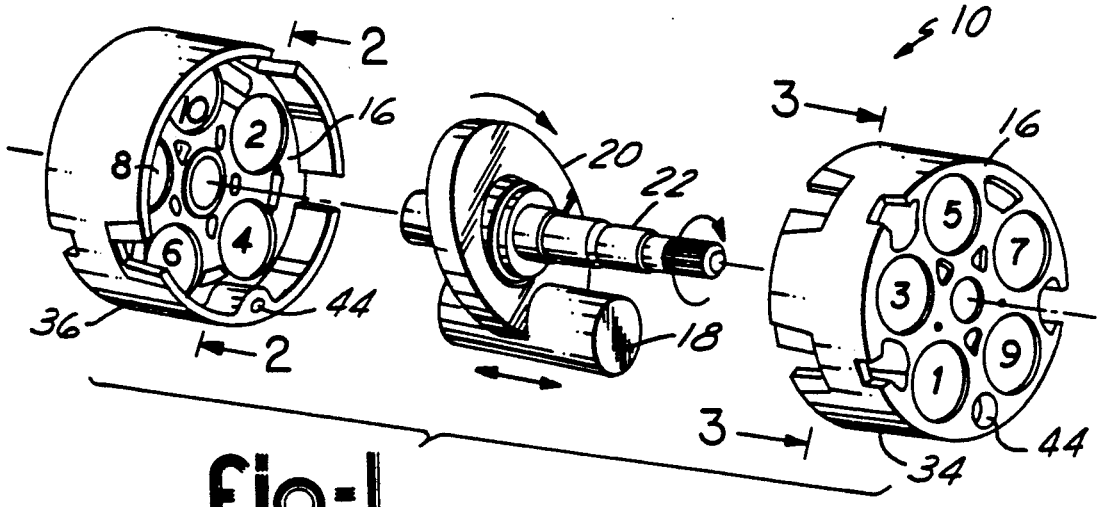
FIG. 1 is a perspective exploded view of an air conditioning pump which suppresses the pulsation and discharge pressure of refrigerant gas during compression by a swash-plate-driven plurality of reciprocating pistons (for clarity only two pistons are shown)
Figure 2:
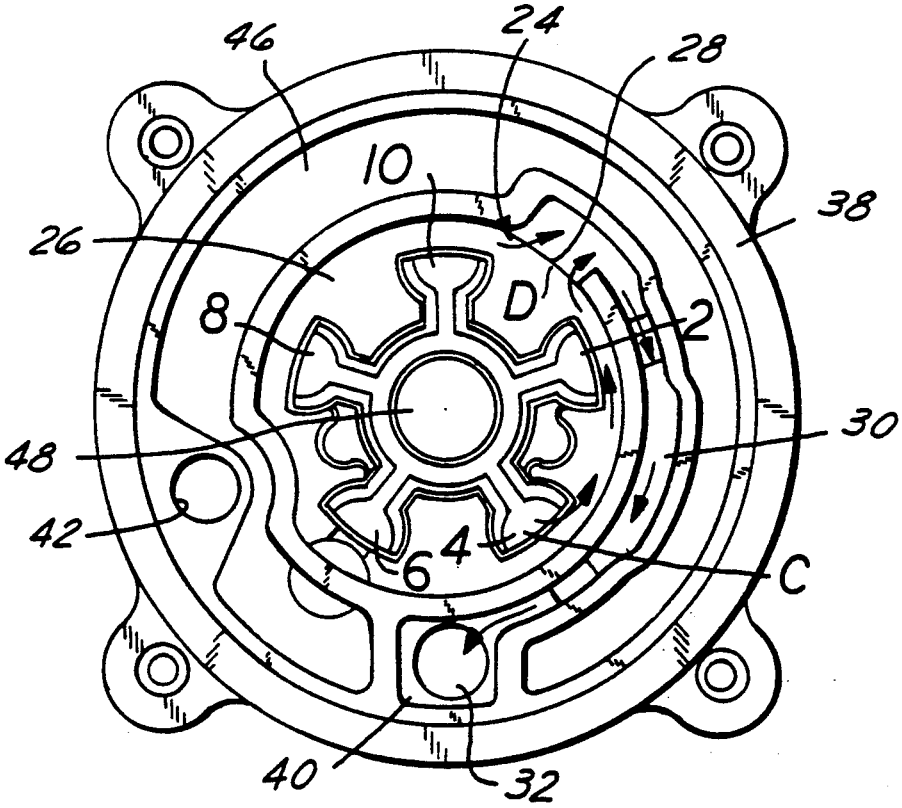
FIG. 2 is a cross-sectional view of an air conditioning pump with a modified discharge transfer cavity according to the present invention taken along the line 2—2 of FIG. 1 when taken from right to left parallel to the axis of the pump.
Figure 3:
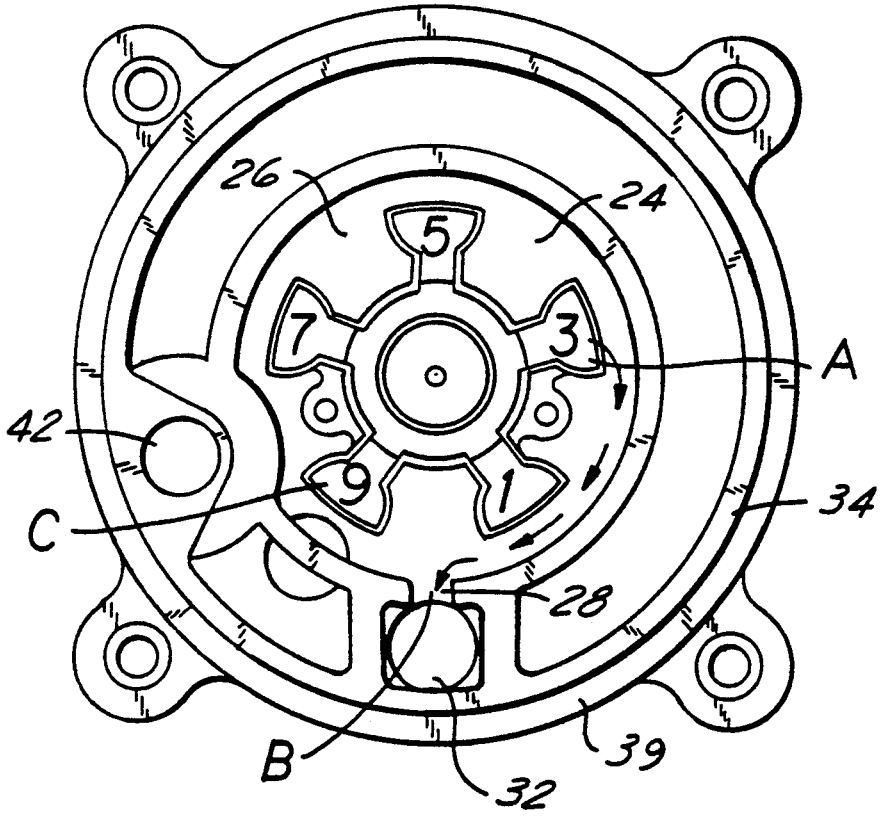
FIG. 3 is a cross-sectional view of an embodiment of an air conditioning pump having an unmodified discharge transfer cavity, and also is a cross-sectional view of the air conditioning pump taken along the line 3—3 of FIG. 1 when taken from left to right parallel to the axis of the pump.

Referring now to FIGS. 1-3 of the drawings, there is depicted in FIG. 1 a perspective and exploded view of an air conditioning pump 10 for propelling refrigerant gas through a cooling circuit. The air conditioning pump 10 comprises a cylinder block 16 assembly which is provided with a plurality of reciprocating pistons 18. For clarity, FIG. 1 depicts only one of such reciprocating pistons 18. In practice, each of the pistons 18 reciprocates within cylinder chambers, the exemplary activation sequence of which is depicted in FIG. 1 by the numerals 1-10. As illustrated, there is an odd number of pistons (five), each piston having an effective end. It will be appreciated that since each piston 18 has two ends, an equal number of the ends is disposed within the front 34 and rear 36 cylinder blocks.

Each piston 18 is in communication with a swash-plate 20 which is fixedly mounted on an axially extending rotatable shaft 22. The reciprocating motion of each piston 18 within its associated cylinder chamber successively syphons, compresses, and discharges refrigerant gas. Incoming gas enters the cylinder block assembly 16 through inlet 42 (FIG. 2) from the cooling circuit (not shown). Compressed gas leaves the cylinder block 16 through a pump discharge port 32, and thence to the cooling circuit.

The cylinder block assembly 16 is received within the hollow bore of a cylinder head assembly 38 (FIG. 2). For clarity, the cylinder heads associated with each cylinder block 16 are omitted from FIG. 1.

Within the cylinder head assembly 38 and cylinder block assembly 16, there is defined a refrigerant gas flow path which is generally depicted by the reference numeral 24 (FIG. 2). The refrigerant gas flow path 24 is in communication with the reciprocating pistons 18 via reed valves and connects the inlet 42 from the cooling circuit with the pump discharge port 32.

In its assembled form, the air conditioning pump 10 depicted in FIG. 1 includes a rear cylinder block 36 into which refrigerant gas enters at inlet 42. Disposed in mating relationship with the rear cylinder block 36 is the front cylinder block 34 (FIG. 1).

Turning now with primary reference to FIG. 2, it will be appreciated that an axially extending discharge cavity 44 (FIG. 1) communicates with the common mixing chamber 40 (FIG. 2) defined within the rear cylinder block 36. Refrigerant gas enters the air conditioning pump 10 through the inlet 42 as a result of low pressure induced by a syphoning action as each piston cycles inwardly within its associated chamber. After ingestion, the reed valve (not shown) of each cylinder impedes the escape of refrigerant gas which is compressed by outward motion of each cylinder. Upon compression, gas is discharged from each cylinder chamber and enters the discharge cavity 26 which is at the front 34 and rear 36 ends of the cylinder block assembly 16. Escape from the discharge cavity 26 of the rear cylinder block 36 occurs through a discharge cavity port 28 which is also defined within the cylinder head 38. After passage through the discharge cavity port 28, compressed refrigerant gas enters an arcuately extending discharge transfer cavity 30. Urged under pressure along the discharge transfer cavity 30, the compressed refrigerant gas enters the pump discharge port 32 for ultimate passage to the cooling circuit (not shown).

In FIG. 2, those chambers or cavities having a negative (suction) pressure are depicted by the reference numerals 42 and 48. Those chambers or cavities which confine a positive (compression) pressure are depicted by the reference numeral 26, 30 and 32.

FIG. 2 depicts that the discharge cavity port 28 is arcuately spaced apart from the pump discharge port 32.

FIG. 3 illustrates an unmodified discharge transfer cavity port 28 which is helpful in distinguishing the modified discharge transfer cavity port depicted in FIG. 2. In FIG. 3, compressed refrigerant gas which accumulates in the discharge cavity 26 has only one means of escape—directly through the pump discharge port 32. For reasons which will be explained later, the noise and vibration associated with the design of FIG. 3 exceed the noise and vibration associated with the embodiment of FIG. 2.

In addition to depicting an unmodified discharge transfer cavity port 28, FIG. 3 also illustrates a cross-sectional view of the front cylinder head 39.

Returning now to FIG. 2, it will be appreciated that the discharge transfer cavity 30 occupies an arcuate length within the rear cylinder head 38. But refrigerant gas which is compressed by pistons associated with the front cylinder block 34 (FIG. 3) must also travel along an axially extending discharge transfer cavity 44 which is defined within the front cylinder block 34 and rear cylinder block 36 before communication with the common mixing chamber 40 (FIG. 2) and pump discharge port 32. The refrigerant gas compressed within the front cylinder block 34 enters via the axially extending discharge transfer cavity 44 (FIG. 1) into the mixing chamber 40 (FIG. 2). The mixing chamber 40 accommodates refrigerant gas entering therewithin after compression by pistons disposed on opposing sides of the rotating swash-plate 20.

For most effective suppression of peak-to-peak pressure pulsation and consequent diminution in noise and vibration, it has been found that the lengths of the arcuately and axially extending discharge transfer cavities must be approximately equal.

A further comparison between FIGS. 2 and 3 will be helpful in appreciating the relationship between distances which the refrigerant gas is required to travel during the compression cycle of the air conditioning pump 10.

In FIG. 3, consider gas which emerges from a given (front) cylinder port (e.g. port 3) at a location designated by the letter A. Before escape through the discharge cavity port 28 at location B, it must travel an arcuate distance A–B. Subsequently, on the opposite (rear) side of the pump 10 (FIG. 2), refrigerant gas compressed by the next cylinder in the activation sequence (cylinder 4) enters the associated discharge cavity 26 at location C. In taking the shortest path, a refrigerant gas particle entering the discharge cavity 26 at C tends to leave the discharge cavity 26 at location D, and thence along the associated arcuately extending discharge transfer cavity 30 to the common mixing chamber 40 (FIG. 2) before exiting through the pump discharge port 32. The travel distance required of such gas particles in the rear cylinder head 38 is represented by the distance C–D, plus the length of the arcuate discharge transfer cavity 30.

To reduce peak-to-peak discharge pressure, the travel distance (A-B) of refrigerant gas from a given cylinder port (e.g. cylinder 3) to the discharge cavity port 28 on one (e.g. front) side of the air conditioning compressor pump 10 must equal the corresponding travel distance (C–D) of refrigerant gas on the opposite (e.g. rear) side of the pump 10 (e.g. cylinder 4). This condition must be satisfied for all cylinders (1–10) when their activation sequence in each pump cycle is considered.

As noted earlier, the lengths of the arcuately and axially extending discharge transfer cavities 30,44 (FIGS. 1–2) are equal in order to reduce pulsation. If distances A–B equal C–D as noted in the previous paragraph, it follows that the following relationship must also be true: the length of the axially extending discharge transfer cavity 44 (FIG. 1) plus A–B (FIG. 3) equals the length of the arcuately extending discharge transfer cavity 30 (FIG. 2) plus C–D. Again, this condition must be satisfied for all cylinders (1–10) when their sequence in each pump cycle is considered.

Turning again to FIG. 2, it will be appreciated that the discharge cavity port 28 is arcuately offset from the pump discharge port 32. Good results have been achieved in the five double-acting piston air conditioning pump 10 when the discharge cavity port 28 is located at about 144 degrees counterclockwise from the pump discharge port 32 in relation to the view depicted in FIG. 2.

During the preceding discussion, the arcuately extending discharge transfer cavity 30 has been defined within the rear cylinder head 38. It will be apparent that the arcuately extending discharge transfer cavity 30 could alternatively be defined within the front cylinder head 39—similarly for the pump discharge port 32. Accordingly, as used herein, the terms "front" and "rear" may be considered alternatively and without limitation.

While the best mode for carrying out the invention has been described in detail, those familiar with the art to which this invention relates will recognize various alternative designs and embodiments for practicing the invention as defined by the following claims.

We claim:

1. An air conditioning pump for propelling refrigerant gas through a cooling circuit, comprising:

a cylinder block assembly including a front cylinder block and a rear cylinder block in mating relationship with the front cylinder block, wherein the cylinder block assembly is provided with a plurality of reciprocating pistons, each piston being in communication with a swash-plate fixedly mounted on an axially extending rotatable shaft, each piston moving within a cylinder chamber adapted for syphoning, compressing, and discharging the refrigerant gas, wherein said plurality of reciprocating pistons are displaced in a given activation sequence during each pump cycle;

a cylinder head assembly which receives the cylinder block assembly; and a refrigerant gas flow path defined within the cylinder block and cylinder head assemblies and being in communication with the plurality of reciprocating pistons, the gas flow path having:

a discharge cavity defined within the cylinder head assembly;

a discharge cavity port defined within the cylinder head assembly in communication with the discharge cavity;

a pump discharge port also defined within the cylinder head assembly;

a discharge transfer cavity connected to the discharge cavity port for delivering the refrigerant gas via the pump discharge port to the cooling circuit, wherein the discharge transfer cavity associated with the rear cylinder block extending arcuately, thereby connecting the discharge cavity port and the pump discharge port; and the front and rear cylinder blocks together defining an axially extending discharge transfer cavity, the length of the arcuately extending discharge transfer cavity approximately equaling the length of the axially extending discharge transfer cavity, and the distance between a cylinder chamber and its associated discharge cavity port associated with the front cylinder block equals the distance between the next cylinder chamber in the activation sequence and its associated discharge cavity port in the rear cylinder block, thereby reducing pulsation within the air conditioning pump and minimizing noise and vibration associated therewith.

2. The air conditioning pump of claim 1 wherein the plurality of reciprocating pistons comprises an odd number thereof.

3. The air conditioning pump of claim 1 wherein each piston has two ends, the air conditioning pump having an equal number of the plurality of reciprocating piston ends disposed within the front and rear cylinder blocks.

4. The air conditioning pump of claim 1 wherein the plurality of reciprocating pistons comprises ten pistons.

5. The air conditioning pump of claim 1 wherein the axially extending rotatable shaft turns in a first direction, and the discharge cavity port associated with the rear cylinder block is located 144 degrees from the pump discharge port, measured in a direction opposite from said first direction.

6. An air conditioning pump for propelling refrigerant gas through a cooling circuit, comprising:

a cylinder block assembly having a rear cylinder block into which refrigerant gas enters, and a front cylinder block in mating relationship with the rear cylinder block, the cylinder block assembly being provided with a plurality of reciprocating pistons, each piston being in communication with a swashplate fixedly mounted on an axially extending rotatable shaft, each piston moving within a cylinder chamber adapted for syphoning, compressing, and discharging the refrigerant gas;

a cylinder head assembly comprising a front cylinder head and a rear cylinder head which respectively receive the front and rear cylinder blocks;

a refrigerant gas flow path defined within the cylinder block and cylinder head assemblies and being in communication with the plurality of reciprocating pistons, the gas flow path having:

a discharge cavity defined within the front and rear cylinder heads;

a discharge cavity port defined within the front and rear cylinder heads in communication with the associated discharge cavity;

a pump discharge port defined within the rear cylinder head; and a discharge transfer cavity connected to the discharge cavity port within the associated cylinder head for delivering the refrigerant gas via the pump discharge port to the cooling circuit, the discharge transfer cavity having an arcuately extending discharge transfer cavity which connects the discharge cavity port and the pump discharge port;

the front and rear cylinder blocks defining an axially extending discharge transfer cavity;

wherein the length of the axially extending discharge transfer cavity defined within the front and rear cylinder blocks plus the distance between the cylinder chamber and its associated discharge cavity port adjacent the front cylinder block equals the length of the arcuately extending discharge transfer cavity of the rear cylinder block plus the distance between the next cylinder chamber in the activation sequence and its associated discharge cavity port adjacent the rear cylinder block.

7. The air conditioning pump of claim 6 wherein each piston has two ends, the air conditioning pump having an equal number of the plurality of reciprocating piston ends disposed within the front and rear cylinder blocks.

8. The air conditioning pump of claim 6 wherein the plurality of reciprocating pistons comprises ten pistons.

* * * * *